US007978164B2

(12) United States Patent
Kawashima et al.

(10) Patent No.: US 7,978,164 B2
(45) Date of Patent: Jul. 12, 2011

(54) LIQUID CRYSTAL DISPLAY DEVICE

(75) Inventors: Yuki Kawashima, Koshigaya (JP); Asahi Yamato, Tokyo (JP); Kohzoh Takahashi, Tokyo (JP); Kiyoshi Nakagawa, Yokohama (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 903 days.

(21) Appl. No.: 11/887,408

(22) PCT Filed: Mar. 24, 2006

(86) PCT No.: PCT/JP2006/305992

§ 371 (c)(1),
(2), (4) Date: Sep. 28, 2007

(87) PCT Pub. No.: WO2006/109532

PCT Pub. Date: Oct. 19, 2006

(65) Prior Publication Data

US 2009/0267963 A1 Oct. 29, 2009

(30) Foreign Application Priority Data

Mar. 30, 2005 (JP) ..... 2005-099809

(51) Int. Cl.
*G09G 3/36* (2006.01)

(52) U.S. Cl. ..... 345/89; 345/690

(58) Field of Classification Search ..... 345/87–103, 345/204, 690

See application file for complete search history.

(56) References Cited

U.S. PATENT DOCUMENTS 6,020,869 A * 2/2000 Sasaki et al. ..... 345/89
2002/0057249 A1 5/2002 Tashiro et al.

FOREIGN PATENT DOCUMENTS

| | | |
|---|---|---|
| JP | 07-056532 | 3/1995 |
| JP | 09-106262 | 4/1997 |
| JP | 09-281943 | 10/1997 |
| JP | 2002-131721 | 5/2002 |
| JP | 2003-177726 | 6/2003 |
| JP | 2004-102296 | 4/2004 |

* cited by examiner

*Primary Examiner* — Stephen G Sherman
(74) *Attorney, Agent, or Firm* — Harness, Dickey & Pierce, P.L.C.

(57) ABSTRACT

A control section (6) merely passes an incoming image data signal DAT onto a source driving section for display driving during the display of a still image. During the display of a moving image, the control section (6) converts, using a computing section (61) and a look-up table (5), a grayscale level signal in the incoming image data signal DAT to a grayscale level signal that is obtainable without using those application voltages at which the response speed of liquid crystal is slow. The control section (6) then outputs the resultant grayscale level signal to the source driving section for display driving.

7 Claims, 4 Drawing Sheets

LIQUID CRYSTAL DISPLAY DEVICE

TECHNICAL FIELD

The present invention relates to liquid crystal display devices.

BACKGROUND ART

The liquid crystal display device has a conventional, well-known problem of slow response. In the liquid crystal display device, the applied voltage to the liquid crystal layer is varied to change the alignment of liquid crystal molecules, which in turn results in a change in display pixel transmittance and hence a change in the display grayscale level. The slow response of the liquid crystal display device is caused by the liquid crystal molecules taking a prolonged period of time to completely change to a different alignment state after a change in the applied voltage to the liquid crystal layer.

Recent wide-screen and high-definition LCDs provide a very short drive period (write period) per pixel. Within the short write period, liquid crystal molecules cannot completely change their alignment in response to a change in the application voltage, and the LCD cannot achieve the desired display grayscale level.

There are approaches that are known to be capable of improving response speed. One example is overshoot driving for forceful grayscale level transition. The approach however entails angular response and other degradation in video quality and may not achieve sufficient speed. The approach also requires memory and other additional components.

To address these issues, for example, Japanese Unexamined Patent Publication (Tokukai) 2002-131721 (published May 9, 2002) discloses a method of improving the response speed by producing displays without using grayscale levels where the response speed slows down. The method is briefly explained.

The LCD's slow response problem does not occur uniformly across the whole range of grayscale levels. The response speed is extremely slow at some levels. For example, an LCD of vertical alignment (VA) in normally black mode exhibits extremely slow rising response speed when changing from a low grayscale level to a middle grayscale level, which can be a cause for after-images and other display problems.

Table 1 shows some results of measurement of the response speed of a VA module capable of producing 256 grayscale levels (0 to 255). The table shows changes of grayscale levels from one of nine levels (0, 32, 64, 96, 128, 160, 192, 224, and 255) to another of the nine levels.

TABLE 1

| Response Speed | | Grayscale Level after Change | | | | | | | | |
|---|---|---|---|---|---|---|---|---|---|---|
| | | 0 | 32 | 64 | 96 | 128 | 160 | 192 | 224 | 255 |
| Grayscale Level after Change | 0 | | F | F | F | F | C | C | B | B |
| | 32 | A | | F | F | C | C | B | B | A |
| | 64 | B | F | | C | C | C | B | B | A |
| | 96 | A | C | C | | C | B | B | B | A |
| | 128 | A | C | C | C | | B | B | B | A |
| | 160 | A | B | C | B | B | | B | B | A |
| | 192 | A | B | C | B | B | C | | B | A |
| | 224 | A | B | C | B | C | B | B | | B |
| | 255 | A | C | B | B | B | B | B | B | |

"A": Less than 1 frame (16.67 ms)
"B": 1 frame to less than 2 frames
"C" 2 frames to less than 3 frames
"F" 3 frames or longer As can be seen from Table 1, the rising response speed is extremely slow, taking three or more frames to respond, when the grayscale level changes from 0 to middle level values (32, 64, 96, 128). Other entries showing an extremely slow rising response speed are mostly found where the grayscale level changes from a low value to a middle value.

Accordingly, the liquid crystal drive method of Tokukai 2002-131721 does not use those changes from low grayscale levels to middle grayscale levels where the rising response speed is slow. FIG. 4 identifies a typical range of liquid crystal driving voltage as A to B. In that convention, the range of liquid crystal driving voltage where the response speed is extremely slow is from A to C. The liquid crystal drive method of Tokukai 2002-131721 does not use the range A to C, but uses only the range C to B when driving liquid crystal. The voltage at A is not 0 volts because the response of the liquid crystal used with VA scheme is inherently slow in the absence of applied voltage.

DISCLOSURE OF INVENTION

The conventional liquid crystal display device of Tokukai 2002-131721 produces a display by simply not using those grayscale levels at which its response speed is slow. That translates into a lack of low grayscale level displays, or a narrow reproducible luminance range when compared with ordinary display driving. That in turn causes poor contrast and other display quality degradation.

Although the liquid crystal display device of Tokukai 2002-131721 is especially effective for improved moving image display capability. For the display of a still image with no or little change in display grayscale level, the device is hardly effective, still suffering likewise from poor contrast and other shortcomings. Tokukai 2002-131721 focuses only on improved moving image display capability and ignores drawbacks in producing still image displays.

The drawbacks in still image display may be addressed by switching the range of liquid crystal application voltage between such a range that no grayscale levels of slow response speed are produced (for example, the range C to B in FIG. 4) for the display of a moving image and an ordinary range (for example, the range A to B in FIG. 4) for the display of a still image.

However, the voltage range switching raises the following problems.

The liquid crystal display device which produces 256 grayscale levels needs 256 application voltage values. In practice, the device cannot provide power supply voltages which correspond to all these grayscale voltages. Typically, several reference voltages are produced from a power supply voltage, and the reference voltages are divided with voltage dividing means to deliver application voltages covering all the grayscale levels.

If the voltage dividing means had only to proportionally divide the reference voltages, one could switch between the ranges of liquid crystal application voltage by simply switching between the reference voltages. However, in the liquid crystal display device, the grayscale level is not in proportion to the application voltage; the relationship gives a unique γ-curve. The voltage dividing means is thus adapted to produce grayscale voltages according to the γ-curve; it does not proportionally divide the reference voltages. Under these conditions, by simply switching between the incoming reference voltages in order to switch between the ranges of liquid crystal application voltage, one cannot obtain a proper γ-curve either during the display of a moving image or during the display of a still image, or in both occasions.

The present invention, conceived in view of these problems, has an objective of providing a liquid crystal display device which exhibits improved response speed during the display of a moving image without causing a drop in contrast and other display quality degradation during the display of a still image.

A liquid crystal display device in accordance with the present invention, to solve the problems, is characterized as follows. The device modulates application voltages according to grayscale levels in input image data to produce a grayscale display. The device includes: a source driving section for converting a grayscale level signal for the input image data to application voltage outputs for output to a display section; a data converting section, provided immediately before the source driving section, for converting the grayscale level signal to a grayscale level signal that is obtainable without using those application voltages which correspond to rising response speeds of liquid crystal less than or equal to a predetermined value; a switching section for selectively switching on/off a conversion process for the grayscale level signal in the data converting section; and a control section for controlling the switching on/off by the switching section in accordance with an input image data indicator signal.

The configuration allows, through the switching by the switching section, a suitable selection as to whether to convert in the data converting section the grayscale level signal to a grayscale level signal that is obtainable without using those application voltages which correspond to rising response speeds of liquid crystal less than or equal to a predetermined value for subsequent output to the source driving section or to merely pass the grayscale level signal onto the source driving section without subjecting the signal to a conversion. For these reasons, if the input image data does not pose any problems in relation to response speed, the conversion process of the grayscale level signal in the data converting section is disabled. Meanwhile, if the input data poses a problems with the response speed, the grayscale level signal is converted in the data converting section to a grayscale level signal that is obtainable without using those application voltages which correspond to rising response speeds of liquid crystal less than or equal to a predetermined value, and the resultant grayscale level signal is output to the source driving section. The configuration alleviates response speed problems without causing an undesirable drop in contrast.

If the response speed problems are addressed by simply not using any of the application voltage levels at which the response speed is slow, no low grayscale levels are reproduced. That narrows down the reproducible luminance range when compared to ordinary display driving. That causes a drop in contrast and other display quality degradation problems. In contrast, the configuration of the present invention can prohibit reproduction of low grayscale levels if necessary. The configuration alleviates the response speed problems without causing an undesirable drop in contrast.

In the configuration, the input image data indicator signal may be a moving image/still image indicator signal. Furthermore, the control section may be adapted to, in response to the moving image/still image indicator signal, control the switching on/off by the switching section to enable the conversion process for the grayscale level signal in the data converting section during a display of a moving image and disable the conversion process for the grayscale level signal in the data converting section during a display of a still image.

According to the configuration, if the input image data represents a moving image, the data converting section converts the grayscale level signal obtained from the input image data to a grayscale level signal that is obtainable without using those application voltages at which the response speed of the liquid crystal is as slow as a predetermined value or even slower, before outputting the resultant grayscale level signal to the source driving section. That reduces blurs in the moving image that are caused by slow response speed. On the other hand, if the input image data represents a still image, the data conversion process in the data converting section is disabled. The grayscale level signal obtained from the input image data is passed onto the source driving section without being subjected to any conversion. The still image is thus displayed with high quality with no drop in contrast.

If no low grayscale levels are reproduced at all, that will contribute to the improvement of moving image display capability. Nevertheless, the effects are hardly felt with a still image display which involves no or marginal grayscale level change. That only leaves disadvantages (poor contrast). On the other hand, the configuration of the present invention can prohibit reproduction of low grayscale levels only during the display of a moving image. That alleviates the response speed problems during the display of a still image without causing an undesirable drop in contrast.

In the configuration, the source driving section, during the display of a moving image, may assign application voltages for grayscale levels during the display of a moving image so that for grayscale levels higher than or equal to a predetermined grayscale level, a different application voltage is assigned for each grayscale level and that of the other grayscale levels, some different grayscale levels are reproduced using the same application voltages. Thus, fewer grayscale levels (for example, 256−15=241) are used in the display of a moving image than in the full grayscale display (for example, 256 grayscale levels) of a still image.

According to the configuration, if the moving image being displayed appears too bright across the screen, those application voltages which are assigned for more than one grayscale level may be moved to low grayscale levels which are not often used for display so that they do not appear at the other grayscale levels. Specifically, at the high grayscale levels (for example, at grayscale levels 129 to 255), a different application voltage is assigned for each grayscale level so that no application voltage is assigned for more than one grayscale level, thereby achieving a full grayscale display. The assignment produces application voltages in accordance with the ideal γ-curve at the high grayscale levels similarly to the display of a still image. No drop in contrast occurs in the application voltage range.

In contrast, at the low grayscale levels (for example, at grayscale levels 0 to 128) which are not often used for display, the remaining application voltages, not used for the high grayscale levels, are properly assigned (for example, V16 to V128 are assigned for grayscale levels 0 to 128) so as to reduce discrepancy from the γ-curve. That translates into fewer grayscale levels being used for display at the low grayscale levels than at the high grayscale levels. With this assignment, those application voltages which are assigned for more than one grayscale level are found only at the low grayscale levels where there occurs a rather large discrepancy from the ideal γ-curve. Nevertheless, since the low grayscale levels are assumed not to be used often for display, the display is not much affected. Therefore, although there occurs a rather large discrepancy from the ideal γ-curve at the low grayscale levels (for example, at grayscale levels 0 to 128), since the low grayscale levels are assumed in the first place not to be used often for display, the display is affected, if at all, only in a limited manner.

For example, a liquid crystal display device which produces 256 grayscale levels needs 256 application voltage values. In practice, the device cannot provide power supply voltages which correspond to all these grayscale voltages. Typically, several reference voltages are produced from a power supply voltage, and the reference voltages are divided with voltage dividing means to deliver application voltages covering all the grayscale levels.

If the voltage dividing means had only to proportionally divide the reference voltages, one could switch between the ranges of liquid crystal application voltage by simply switching between the reference voltages. However, in the liquid crystal display device, the grayscale level is not in proportion to the application voltage; the relationship gives a unique γ-curve. The voltage dividing means is thus adapted to produce grayscale voltages according to the γ-curve; it does not proportionally divide the reference voltages. Under these conditions, by simply switching between the incoming reference voltages in order to switch between the ranges of liquid crystal application voltage, one cannot obtain a proper γ-curve either during the display of a moving image or during the display of a still image, or in both occasions.

In contrast, according to the configuration of the present invention, some application voltages are assigned for more than one grayscale level so that these application voltages are found only at the low grayscale levels which are not often used for display. At the high grayscale levels which are often used for display, no application voltage is assigned for more than one grayscale level. That reduces adverse effects on the display of the discrepancy from the ideal γ-curve. A good display is produced consistently during the display of a moving image and during the display of a still image.

In the configuration, the source driving section, during the display of a moving image, may assign application voltages for grayscale levels during the display of a moving image so that for grayscale levels lower than or equal to a predetermined grayscale level, a different application voltage is assigned for each grayscale level and that for the other grayscale levels, some application voltages are assigned for more than one grayscale level, thereby using fewer grayscale levels for the display of a moving image than for the display of a still image.

According to the configuration, if the moving image being displayed appears too dark across the screen (for example, if the video was shot at night), the application voltages assigned for more than one grayscale level are found only at high grayscale levels which are not often used for display. Specifically, at the low grayscale levels (for example, at grayscale levels 0 to 128), a different application voltage is assigned for each grayscale level (for example, V16 to V144 are assigned for grayscale levels 0 to 128) to achieve a full grayscale display. The assignment produces application voltages in accordance with the ideal γ-curve at the low grayscale levels similarly to the display of a still image. No drop in contrast occurs in the application voltage range.

In contrast, at the high grayscale levels (for example, at grayscale levels 129 to 255) which are not often used for display, the remaining application voltages, not used for the low grayscale levels, are properly assigned (for example, V145 to V255 are assigned for grayscale levels 129 to 255) so as to reduce discrepancy from the γ-curve. That translates into fewer grayscale levels being used for display at the high grayscale levels than at the low grayscale levels. Therefore, although the application voltages assigned for more than one grayscale level are found only at the high grayscale levels, and there occurs a rather large discrepancy from the ideal γ-curve, since the high grayscale levels are assumed in the first place not to be used often for display, the display is affected, if at all, only in a limited manner.

Another liquid crystal display device in accordance with the present invention, to solve the problems, is characterized as follows. The device modulates application voltages according to grayscale levels in input image data to produce a grayscale display. The device includes: a source driving section for converting a grayscale level signal obtained from the input image data to application voltage outputs for output to a display section; a data converting section, provided immediately before the source driving section, for converting the grayscale level signal to a grayscale level signal that is obtainable without using those application voltages at which response speed of liquid crystal is slow; and a switching section for switching on/off a data conversion process carried out by the data converting section.

In the liquid crystal display device, the switching section preferably enables the data conversion process carried out by the data converting section during a display of a moving image and disables the data conversion process carried out by the data converting section during a display of a still image.

According to the configuration, the data converting section converts a grayscale level signal obtained from the input image data to a grayscale level signal that is obtainable without using those application voltages at which response speed of liquid crystal is slow. Supplying the grayscale level signal which has undergone the conversion process in the data converting section to the source driving section reduces blurs in the moving image that are caused by slow response speed.

The switching section switches on/off of the data conversion process carried out by the data converting section. Disabling the data conversion process carried out by the data converting section and supplying the grayscale level signal obtained from the input image data to the source driving section without any conversion produces a good still image with no drop in contrast.

In the liquid crystal display device, the data converting section may carry out the data conversion process so as to select, from application voltages that can be generated by the source driving section, those application voltages which are the closest to ideal application voltages in accordance with the grayscale levels in input image data.

According to the configuration, in the data conversion process, the data converting section assigns, of application voltages that can be generated by the source driving section, those application voltages which are the closest to ideal application voltages in accordance with the grayscale levels in input image data. The source driving section carries out the same process regardless of whether the data conversion process carried out by the data converting section is enabled or disabled. That allows simplification of circuitry in the source driving section. Ideal application voltages with respect to grayscale levels in input image data are those application voltages which has a relationship with grayscale levels that is well represented by the γ-curve in the application voltage range used.

Another liquid crystal display device in accordance with the present invention, to solve the problems, modulates application voltages according to grayscale levels in input image data to produce a grayscale display. The device includes a source driving section for converting a grayscale level signal to application voltage outputs for output to a display section. The source driving section includes: a first converting section for converting the grayscale level signal to the application voltage outputs during a display of a still image; a second converting section for converting the grayscale level signal to application voltage outputs that are obtainable without using those application voltages which correspond to rising response speeds of liquid crystal less than or equal to a predetermined value during a display of a moving image; and a selector section for selecting/switching between the first converting section and the second converting section for use.

According to the configuration, the second converting section converts the grayscale level signal to application voltage outputs that are obtainable without using those application voltages at which the response speed of liquid crystal is slow during the display of a moving image. That reduces blurs in the moving image that are caused by slow response speed. The first converting section converts the grayscale level signal to more application voltage outputs during the display of a still image than the second converting section. That enables a good display with no drop in contrast.

Furthermore, the first converting section and the second converting section are provided separately and selectable by the use of the selector section. The grayscale level-application voltage relationship is in accordance with an optimal γ-curve both during the display of a moving image and during the display of a still image. Optimal display quality becomes available.

As described in the foregoing, the liquid crystal display device of the present invention modulates application voltages according to grayscale levels in input image data to produce a grayscale display. The device includes: a source driving section for converting a grayscale level signal obtained from the input image data to application voltage outputs for output to a display section; a data converting section, provided immediately before the source driving section, for converting the grayscale level signal to a grayscale level signal that is obtainable without using those application voltages at which response speed of liquid crystal is slow; and a switching section for switching on/off a data conversion process carried out by the data converting section.

Therefore, the data converting section, during the display of a moving image, converts a grayscale level signal obtained from the input image data to a grayscale level signal that is obtainable without using those application voltages at which response speed of liquid crystal is slow. That reduces blurs in the moving image that are caused by slow response speed.

During the display of a still image, the switching section disables the data conversion process carried out by the data converting section so that the grayscale level signal obtained from the input image data can be output to the source driving section without undergoing any conversion. That enables a good still image display with no drop in contrast.

Additional objects, advantages and novel features of the invention will be set forth in part in the description which follows, and in part will become apparent to those skilled in the art upon examination of the following or may be learned by practice of the invention.

BEST MODE FOR CARRYING OUT INVENTION

Embodiment 1

Figure 1:
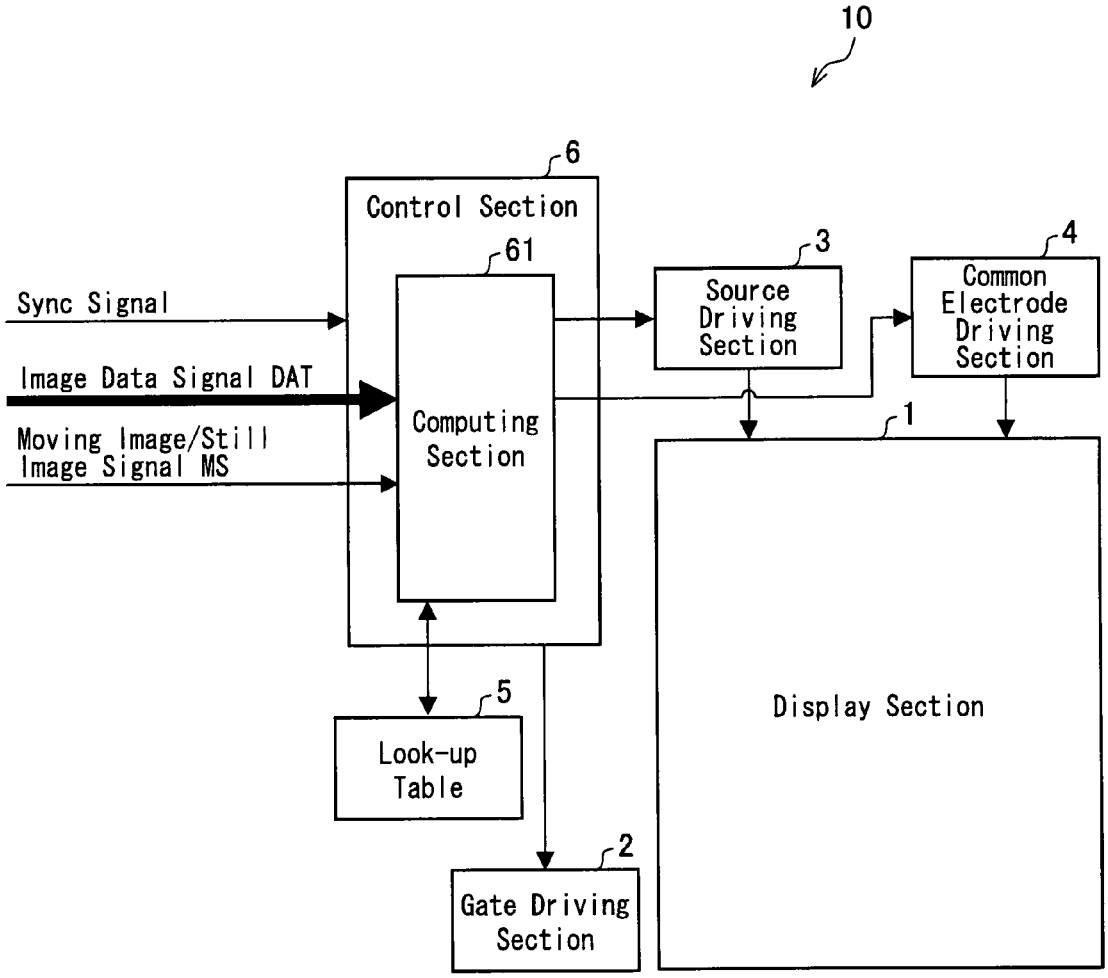
FIG. 1 A block diagram for an embodiment of the present invention illustrating schematically the configuration of a liquid crystal display device in accordance with embodiment 1.
Figure 2:
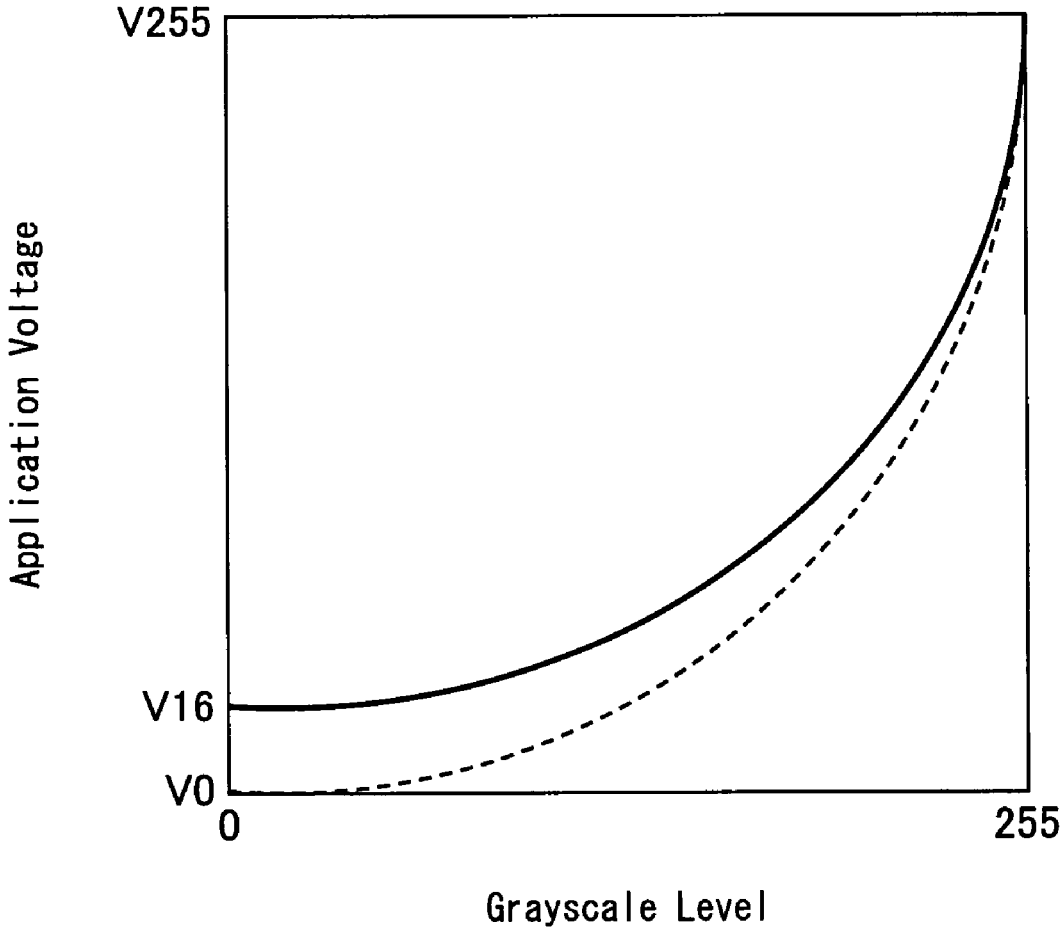
FIG. 2 A graph representing a relationship between grayscale level and application voltage.

The following will describe an embodiment of the present invention in reference to FIGS. 1 and 2.

An active matrix liquid crystal display device 10 in accordance with present embodiment 1, as an example, includes a display section 1, a gate driving section 2, a source driving section 3, a common electrode driving section 4, a look-up table (data converting section) 5, and a control section 6 as shown in FIG. 1.

The display section 1 has m parallel scan signal lines, n parallel data signal lines, and a matrix of pixels (details omitted from the figure). The pixels are provided in areas surrounded by two adjacent scan signal lines and two adjacent data signal lines.

The gate driving section 2 sequentially generates scan signals and feeds them to the scan signal lines connected to the pixels in each row according to a gate clock signal and gate start pulses supplied from the control section 6.

The source driving section 3 samples an image data signal DAT and feeds the obtained image data to the data signal lines connected to the pixels in each column according to a source clock signal and source start pulses supplied from the control section 6.

The control section 6 is a circuit generating and outputs various control signals for the control of the gate driving section 2 and the source driving section 3 from an incoming sync signal, image data signal DAT, and moving image/still image indicator signal MS. The control signals from the control section 6 include the aforementioned clock signals, start pulses, and image data signal DAT. The control section 6 further includes a computing section (switching section) 61 which carries out a data conversion on the image data signal DAT during the display of a moving image. The data conversion by the computing section 61 is performed based on data stored in the look-up table 5 (details will be given later).

Each pixel in the display section 1 is constructed of, for example, a switching element (e.g., TFT (thin film transistor)) and a liquid crystal capacitor. The gate of the TFT is connected to an associated one of the scan signal lines. One of the electrodes of the liquid crystal capacitor is connected to an associated one of the data signal lines via the drain and source of the TFT. The other electrode of the liquid crystal capacitor is connected to a common electrode line that is shared by all the pixels. The common electrode driving section 4 supplies voltage which is applied to the common electrode line.

In the liquid crystal display device 10, the gate driving section 2 selects one of the scan signal lines. The source driving section 3 outputs the image data signal DAT to the data signal lines so that the signal DAT reaches the pixels located at the intersections of the scan signal line being selected and the data signal lines. Thus, image data is written to the individual pixels connected to the scan signal lines. The gate driving section 2 then selects another scan signal line, and the source driving section 3 feeds image data to the data signal lines. By repeating the actions, all the pixels in the display section 1 are supplied with respective sets of image data. An image is thus displayed on the display section 1 in accordance with the image data signal DAT.

The image data output from the control section 6 (image data signal DAT) is transmitted serially to the source driving section 3. The source driving section 3 extracts sets of image data from the image data signal DAT at timings given by the source clock signal, an inverted source clock signal, and source start pulses (timing signal). The source driving section 3 then feeds the sets of image data to the respective pixels.

The response speed is known to slow down, for example, when the grayscale level rises from a low value in normally black mode, which poses problems in the display of a moving image. The response speed is particularly slow if the rise occurs from a low value to another low value. Conversely, in normally white mode, the response speed is known to slow down when the grayscale level falls from a high value, especially, when the falls occurs from a high value to another high value.

The liquid crystal display device 10 of present embodiment 1 improves its response speed during the display of a moving image by using no grayscale levels where the response speed is slow.

Suppose that the entire grayscale is divided into 256 levels, that is, levels 0 to 255 and also that the response particularly slow for application voltages V0 to V15 which correspond to grayscale levels 0 to 15 in normally black mode. Under these conditions, the liquid crystal display device 10 of present embodiment 1 displays a moving image by using none of application voltages V0 to V15, but using only application voltages V16 to V255 which correspond to grayscale levels 16 to 255, in the driving of the display section 1.

A natural consequence of the prohibition of using application voltages V0 to V15, out of application voltages V0 to V255, is a narrower available application voltage range as shown in FIG. 2. A narrower application voltage range means a narrower reproducible luminance range and lower contrast. Remember that during the display of a still image, the prohibition of using application voltages V0 to V15 brings no improvement to moving image display capability; it has only disadvantages (poor contrast). Accordingly, the liquid crystal display device 10 limits the application voltage range to from V16 to V255 only during the display of a moving image, and during the display of a still image, uses the ordinary application voltage range (V0 to V255). The "still image" here does not exclusively mean a completely still image with no animation at all. It also refers to an image with a relatively fewer motions than the "moving" image in the present context.

In normally white mode, if the response is especially slow, for example, for application voltages V255 to V241 which correspond to grayscale levels 255 to 241, the device 10 uses only application voltages V0 to V240 which correspond to grayscale levels 0 to 240 in the driving of the display section 1.

Now, will be described a method of switching the application voltage outputs to the display section 1 between different ranges, one for the display of a moving image and another for the display of a still image, in the liquid crystal display device 10 of present embodiment 1.

A still image is displayed by ordinary driving. The control section 6 merely passes the incoming image data signal DAT onto the source driving section 3. The source driving section 3 contains voltage dividing means which receives plural reference voltages and divides them with resistors to produce application voltages (V0, V1, V2, . . . , V255) covering all the grayscale levels.

The voltage dividing means is constructed of many resistors connected in series. The means produces various voltages which appear at the contacts of the resistors. The voltages are selectable for the application voltages by switching control in accordance with the image data signal DAT. The image data signal DAT is, for example, an 8-bit digital signal (for 256 grayscale levels). With each bit enabling one stage of switching control, the 8-bit signal allows a desired application voltage to be selected from the 256 voltages. The voltage dividing means is part of a conventional, well-known configuration for voltage-modulating liquid crystal display devices.

A moving image is displayed differently. Suppose, however, that the image data signal DAT represents 256 grayscale levels as in the previous case of a still image. The description takes an example where the response is especially slow for application voltages V0 to V15 which correspond to grayscale levels 0 to 15 for a still image, and these application voltages are not used for the display of a moving image. Ideally in terms of display quality, if one is to produce a 256-grayscale level display using the voltage range from V16 to V255 which was used for the display of a still image, that range should be divided by 256 to produce application voltages V'0, V'1, V'2, . . . , V'255.

However, application voltages V'0 to V'255 are ideal, but not obtainable by setting the lowest and highest reference voltage inputs to the voltage dividing means to V16 to V255 respectively and dividing the voltage range from V16 to V255 by 256. The γ-curve, representing the grayscale level versus application voltage relationship, differs during the display of a still image in which the application voltage range from V0 to V255 is used and during the display of a moving image in which the application voltage range from V16 to V255 is used.

Therefore, the liquid crystal display device 10 of present embodiment 1 displays a moving image by using only application voltage V16 to V255 out of V0 to V255 generated by the voltage dividing means and using the application voltages selectively so that the obtained grayscale level versus application voltage curve best approximates the preset γ curve.

As an example, suppose that each application voltage V'0 to V'255, which is ideal to produce a 256-grayscale level display on the liquid crystal display device 10, is closest to the one of application voltages V32 to V255 generated by the voltage dividing means as shown in Table 2.

TABLE 2

| Input Grayscale Level | Ideal Application Voltage V' during Moving Image Display | Applicatino Voltage V Closest to Application Voltage V' Producible by Voltage Dividing Means | Output Grayscale Level |
|---|---|---|---|
| 0 | V'0 | V16 | 16 |
| 1 | V'1 | V16 | 16 |
| 2 | V'2 | V17 | 17 |
| 3 | V'3 | V18 | 18 |
| . | . | . | . |
| . | . | . | . |
| . | . | . | . |
| 252 | V'252 | V254 | 254 |
| 253 | V'253 | V254 | 254 |
| 254 | V'254 | V255 | 255 |
| 255 | V'255 | V255 | 255 |

The ideal application voltage to reproduce grayscale level 0 during the display of a moving image is V'0 which matches application voltage V16 for the display of a still image. Thus, application voltage V16 for the display of a still image is used to reproduce grayscale level 0 during the display of a moving image. Likewise, application voltage V255 for the display of a still image is used to reproduce grayscale level 255 during the display of a moving image.

If one wants to reproduce a grayscale level other than 0 and 255 in the display of the moving image, an application voltage V for the display of a still image which matches an ideal application voltage V' for the display of a moving image does not always exist. Therefore, an application voltage V which is closest to the application voltage V' is used. In the example of Table 2, if the application voltage V for the display of a still image which is the closest to the ideal application voltage V'1 for the display of a moving image for input grayscale level 1 is V16, application voltage V16 for the display of a still image is used to reproduce grayscale level 1 during the display of a moving image. Likewise, application voltage V17 for the display of a still image is used to reproduce grayscale level 2 during the display of a moving image. Application voltage V18 for the display of a still image is used to reproduce grayscale level 3 during the display of a moving image. Application voltage V254 for the display of a still image is used to reproduce grayscale levels 252 and 253 during the display of a moving image. Application voltage V255 for the display of a still image is used to reproduce grayscale level 254 during the display of a moving image. In other words, during the display of a moving image, the same application voltage may be used to reproduce different grayscale levels.

During the display of a moving image, the image data signal DAT, fed to the control section 6, undergoes data conversion in the computing section 61 in reference to the look-up table 5 before being supplied to the source driving section 3. The look-up table 5 records the input grayscale levels (left side) and the output grayscale levels (right side) in an associated manner. It receives an input grayscale level represented by the image data signal DAT from the computing section 61 and outputs a corresponding grayscale level. The computing section 61 outputs the grayscale level retrieved from the look-up table 5 to the source driving section 3.

In this manner, the liquid crystal display device 10 of present embodiment 1 has only to switch on/off the data conversion before outputting the image data signal DAT to the source driving section 3, in order to switch between still image display and moving image display. Therefore, there is no need to provide, for example, two types of voltage dividing means, one for still image display and another for moving image display, in source driving section 3 to generate application voltages. That in turn prevents the device's circuitry from growing in complexity and still accomplishes the switching between still image display and moving image display. Also, the grayscale levels obtained after the data conversion during the display of a moving image are produced considering the γ-curve of the application voltage range used for the display of a moving image.

In the liquid crystal display device 10, the switching between still image display and moving image display happens based on a moving image/still image indicator signal MS (for example, depending on whether the moving image/still image indicator signal MS is High or Low). If the image data signal DAT is externally fed to the liquid crystal display device 10, the moving image/still image indicator signal MS may be externally fed simultaneously with the image data signal DAT.

Alternatively, the moving image/still image indicator signal MS may be generated in the liquid crystal display device 10. For example, some recent models of mobile devices (mobile phones and mobile personal computers) can work in television receiver mode. These devices can be regarded as displaying a moving image in television receiver mode and a still image in other operating mode. If the user selects the television receiver mode on the liquid crystal display device 10, it may generate a moving image/still image indicator signal MS indicating moving image display. If the user selects the other operating mode, it may generate a moving image/still image indicator signal MS indicating still image display. Suppose that such a moving image/still image indicator signal MS is generated by a control section (for example, CPU; (not shown). It is of course easy to adapt the device to display a moving image in operating mode, other than the television receiver mode, in which a moving image is likely be displayed.

Alternatively, the device may be adapted so that the user can direct select either the moving image display mode or the still image display mode. If the user selects the moving image display mode, the device may generate a moving image/still image indicator signal MS indicating moving image display. If the user selects the still image display mode, it may generate a moving image/still image indicator signal MS indicating still image display. In this case, the user can select either the moving image display mode or the still image display mode to suit his/her preferences for display images.

Since the moving image display method of present embodiment 1 does not use the application voltage range where the response speed of the liquid crystal slows, the reproducible luminance range narrows down, and the average luminance of the display image changes from that during the display of a still image. Accordingly, display quality is effectively improved by light adjustment using a backlight such that the average luminance of a display image can stay unchanged between the display of a moving image and the display of a still image.

For example, if the present invention is applied to a liquid crystal display device of normally black mode, an unused range occurs in the application voltage range for some low to middle grayscale levels during the display of a moving image. Therefore, the average luminance of the display image would be higher than during the display of a still image. The luminance of the backlight is therefore preferably set to a lower value during the display of a moving image than during the display of a still image. The adjustment of backlight is carried out, for example, to achieve the same luminance for a still image and a moving image when middle grayscale level V128 is being reproduced.

In the liquid crystal display device 10, some different grayscale levels are reproduced using the same voltages during the display of a moving image. Such "dual-role" application voltages (single application voltages assigned for more than one grayscale level) are found across the entire range of application voltages used (in the above example, from V16 to V255).

However, if the moving image being displayed appears too dark across the screen (for example, if the video was shot at night), the dual-role application voltages (single application voltages assigned for more than one grayscale level) may be moved to high grayscale levels which are not often used for display so that they do not appear at the other grayscale levels. Specifically, at low grayscale levels (for example, at grayscale levels 0 to 128), a different application voltage is assigned for each grayscale level (for example, V16 to V144 are assigned for grayscale levels 0 to 128) so that no application voltage is assigned for more than one grayscale level. The assignment produces application voltages in accordance with the ideal γ-curve at the low grayscale levels similarly to the display of a still image. In addition, no drop in contrast occurs in the application voltage range.

At high grayscale levels which are used less often (not so frequently) for display (for example, at grayscale levels 129 to 255), the remaining application voltages, not used for the low grayscale levels, are properly assigned (for example, V145 to V255 are assigned for grayscale levels 129 to 255) so as to reduce discrepancy from the γ-curve. With this assignment, the dual-role application voltages are found only at the high grayscale levels where there occurs a rather large discrepancy from the ideal γ-curve. Nevertheless, since the high grayscale levels are assumed not to be used often for display, the display is not much affected.

This display method produces an even brighter display than when the dual-role application voltages (single application voltages assigned for more than one grayscale level) are found across the entire range of application voltages used. Light adjustment is preferably carried out together to reduce the luminance of the backlight.

However, conversely, if the moving image being displayed appears too bright across the screen, the dual-role application voltages (single application voltages assigned for more than one grayscale level) may be moved to low grayscale levels which are not often used for display so that they do not appear at the other grayscale levels. In this case, the display appears darker than when the dual-role application voltages (single application voltages assigned for more than one grayscale level) are found across the entire range of application voltages used. Light adjustment is preferably carried out together to raise the luminance of the backlight.

To switch between display operations in this manner depending on whether the screen being displayed appears too dark or too bright across the screen, additional moving image display modes (a dark moving image mode and a bright moving image mode) may be provided so that the user can select any of the moving image display modes. This moving image display mode switching is also enabled by mere switching between look-up tables.

Embodiment 2

Figure 3:
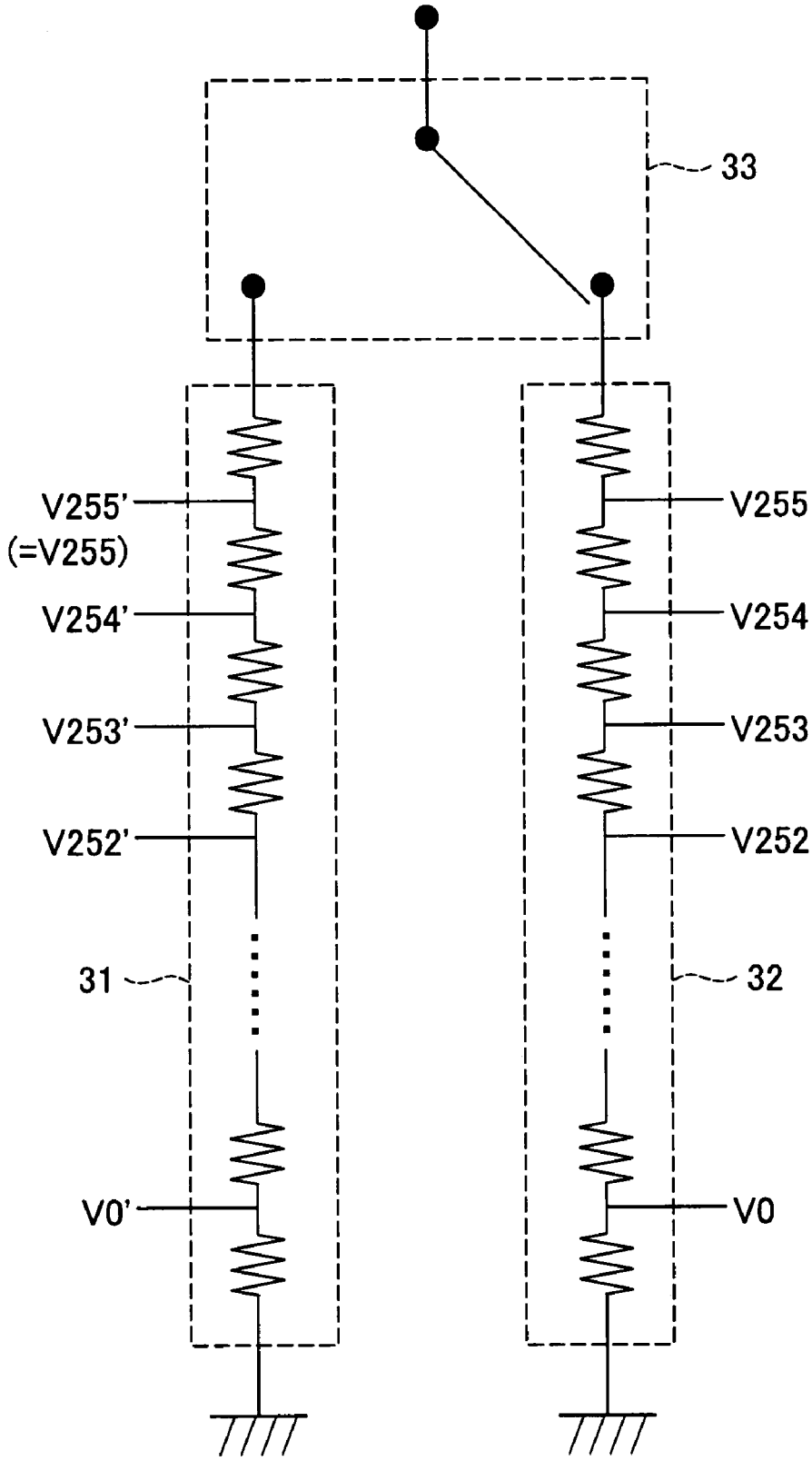
FIG. 3 A circuit diagram illustrating voltage dividing means used in a source driving section in a liquid crystal display device in accordance with embodiment 2.
Figure 4:
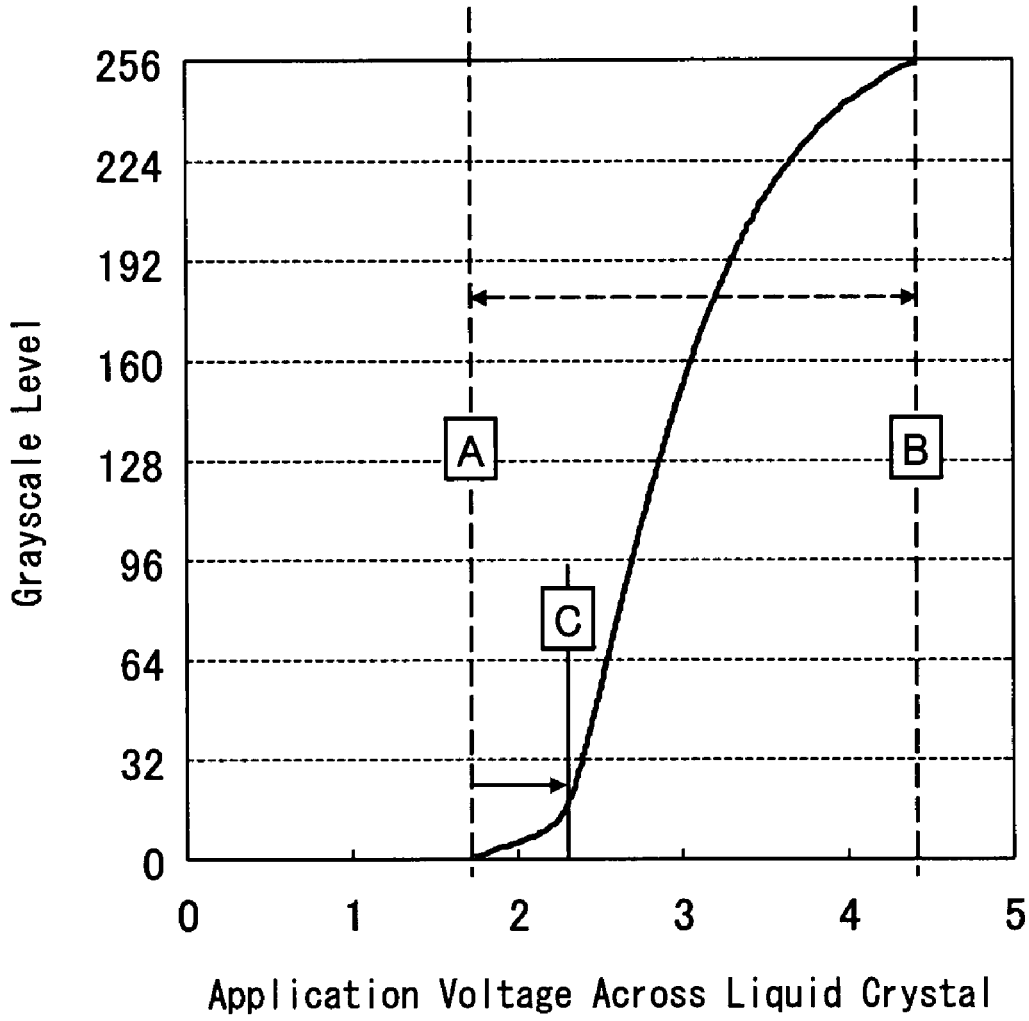
FIG. 4 A graph representing a relationship between grayscale level and application voltage, illustrating a method of eliminating blurs in the moving image by producing a display without using grayscale levels at which response speed is slow.

The following will describe another embodiment of the present invention in reference to FIG. 3.

The liquid crystal display device 10 of embodiment 1 is aimed at simplifying the configuration of the device. the application voltage V for the display of a still image which is the closest to the ideal application voltage V' for the display of a moving image is selectively used so that the same voltage dividing means can be used both during the display of a still image and during the display of a moving image. However, the method does not use the ideal application voltage V' during the display of a moving image. Therefore, some display quality degradation is inevitable when compared to the case where ideal application voltages V' are used for all grayscale levels.

In contrast, the liquid crystal display device of present embodiment 2 includes, as shown in FIG. 3, two types of voltage dividing means in the source driving section 3: one for moving image display (second converting section) and another for still image display (first converting section). The device switches between the two voltage dividing means for use in response to the moving image/still image indicator signal MS. In the configuration shown in FIG. 3, a voltage dividing means 31 for moving image display and a voltage dividing means 32 for still image display are provided in parallel. The switch (selector section) 33 selects either the voltage dividing means 31 or the voltage dividing means 32 as the voltage dividing means for use in response to the moving image/still image indicator signal MS.

In the configuration, the device's circuitry becomes more complex due to the inclusion of individual voltage dividing means for moving image display and for still image display. Nevertheless, the configuration provides a grayscale level-application voltage relationship that best fits an optimal γ-curve for both moving image display and still image display, thereby achieving optimal display quality.

In the liquid crystal display device of present embodiment 2, the image data signal DAT, fed to the control section 6, is supplied to the source driving section 3 without undergoing any data conversion. The computing section 61 and the look-up table 5 are no longer needed.

As described in the foregoing, the liquid crystal display device 10 in accordance with the present invention modulates application voltages according to grayscale levels in input image data DAT to produce a grayscale display. The device 10 is characterized in that it includes: the source driving section 3 for converting a grayscale level signal obtained from the input image data DAT to application voltage outputs for output to the display section 1; the look-up table 5, provided immediately before the source driving section 3, for converting the grayscale level signal to a grayscale level signal that is obtainable without using those application voltages which correspond to rising response speeds of the liquid crystal less than or equal to a predetermined value; the computing section 61 for selectively switching on/off a conversion process for the grayscale level signal using the look-up table 5; and the control section 6 for controlling the switching on/off by the computing section 61 in accordance with an incoming control signal generated from a sync signal, an image data signal DAT, and a moving image/still image indicator signal MS.

The configuration allows, through the switching by the computing section 61, a suitably selection as to whether to convert using the look-up table 5 the grayscale level signal to a grayscale level signal that is obtainable without using those application voltages which correspond to rising response speeds of liquid crystal less than or equal to a predetermined value for subsequent output to the source driving section 3 or to merely pass the grayscale level signal onto the source driving section 3 without subjecting the signal to a conversion. For these reasons, if the input image data DAT does not pose any problems in relation to response speed, the conversion process of the grayscale level signal in the data converting section 3 is disabled. Meanwhile, if input image data poses a problem with the response speed, the grayscale level signal is converted in the data converting section 3 to a grayscale level signal that is obtainable without using those application voltages which correspond to rising response speeds of liquid crystal less than or equal to a predetermined value, and the resultant grayscale level signal is output to the source driving section 3. The configuration alleviates response speed problems without causing an undesirable drop in contrast also when images are displayed without raises any problems with the response speed.

If the response speed problems are addressed by simply not using any of the application voltage levels at which the response speed is slow, no low grayscale levels are reproduced. That narrows down the reproducible luminance range when compared to ordinary display driving. That causes a drop in contrast and other display quality degradation problems. In contrast, the configuration of the present invention can prohibit reproduction of low grayscale levels if necessary. The configuration alleviates the response speed problems without causing an undesirable drop in contrast.

In the configuration, the controller 6 may be adapted to, in response to the moving image/still image indicator signal MS, control the switching on/off by the computing section 61 to enable the conversion process for the grayscale level signal using the look-up table 5 during the display of a moving image and disables the conversion process for the grayscale level signal during the display of a still image.

According to the configuration, if the input image data DAT represents a moving image, the data converting section 3 converts, using the look-up table 5, the grayscale level signal obtained from the input image data DAT to a grayscale level signal that is obtainable without using those application voltages at which the response speed of liquid crystal is as slow as a predetermined value or even slower, before outputting the resultant grayscale level signal to the source driving section 3. That reduces blurs in the moving image that are caused by slow response speed. On the other hand, if the input image data represents a still image, the data conversion process using the look-up table 5 is disabled. The grayscale level signal obtained from the input image data DAT is passed onto the source driving section 3 without being subjected to any conversion. The still image is thus displayed with high quality with no drop in contrast.

If no low grayscale levels are reproduced at all, that will contribute to the improvement of moving image display capability. Nevertheless, the effects are hardly felt with a still image display which involves no or marginal grayscale level change. That only leaves disadvantages (poor contrast). On the other hand, the configuration of the present invention can prohibit reproduction of low grayscale levels only during the display of a moving image. That alleviates the response speed problems during the display of a still image without causing an undesirable drop in contrast.

In the configuration, the source driving section 3, during the display of a moving image, may assign application voltages for grayscale levels during the display of a moving image so that for grayscale levels higher than or equal to a predetermined grayscale level, a different application voltage is assigned for each grayscale level and that of the other grayscale levels, some different grayscale levels are reproduced using the same application voltages. Thus, fewer grayscale levels (for example, 256−15=241) are used in the display of a moving image than in the full grayscale display (for example, 256 grayscale levels) of a still image.

According to the configuration, if the moving image being displayed appears too bright across the screen, those application voltage which are assigned for more than one grayscale level may be moved to low grayscale levels which are not often used for display so that they do not appear at the other grayscale levels. Specifically, at the high grayscale levels (for example, at grayscale levels 129 to 255), a different application voltage is assigned for each grayscale level so that no application voltage is assigned for more than one grayscale level, thereby achieving a full grayscale display. The assignment produces application voltages in accordance with the ideal γ-curve at the high grayscale levels similarly to the display of a still image. No drop in contrast occurs in the application voltage range.

In the configuration, the source driving section 3, during the display of a moving image, may assign application voltages for grayscale levels during the display of a moving image so that for grayscale levels lower than or equal to a predetermined grayscale level, a different application voltage is assigned for each grayscale level and that of the other grayscale levels, some different grayscale levels are reproduced using the same application voltages. Thus, fewer grayscale levels (for example, 256−15=241) are used in the display of a moving image than in the full grayscale display (for example, 256 grayscale levels) of a still image.

According to the configuration, if the moving image being displayed appears too dark across the screen (for example, if the video was shot at night), the application voltages assigned for more than one grayscale level are found only at high grayscale level which are not often used for display. Specifically, at the low grayscale levels (for example, at grayscale levels 0 to 128), a different application voltage is assigned for each grayscale level (for example, V16 to V144 are assigned for grayscale levels 0 to 128) to achieve a full grayscale display. The assignment produces application voltages in accordance with the ideal γ-curve at the low grayscale levels similarly to the display of a still image. No drop in contrast occurs in the application voltage range.

In contrast, at the high grayscale levels (for example, at grayscale levels 129 to 255) which are not often used for display, the remaining application voltages, not used for the low grayscale levels, are properly assigned (for example, V145 to V255 are assigned for grayscale levels 129 to 255) so as to reduce discrepancy from the γ-curve. That translates into fewer grayscale levels being used for display at the high grayscale levels than at the low grayscale levels. Therefore, although the application voltages assigned for more than one grayscale level are found only at the high grayscale levels, and there occurs a rather large discrepancy from the ideal γ-curve, since the high grayscale levels are assumed in the first place not to be used often for display, the display is affected, if at all, only in a limited manner.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The invention is applicable to liquid crystal display devices producing still image and moving image displays. The invention alleviates response speed problems during the display of a moving image without causing a drop in contrast during the display of a still image.

The invention claimed is:

1. A liquid crystal display device modulating application voltages according to grayscale levels in input image data to produce a grayscale display, said device comprising:

a source driving section for converting a grayscale level signal for the input image data to application voltage outputs for output to a display section;

a data converting section, provided immediately before the source driving section, for converting the grayscale level signal to a grayscale level signal that is obtainable without using those application voltages which correspond to rising response speeds of the liquid crystal less than or equal to a predetermined value;

a switching section for selectively switching on/off a conversion process for the grayscale level signal in the data converting section; and a control section for controlling the switching on/off by the switching section in accordance with an input image data indicator signal, wherein the source driving section, during display of a moving image, assigns application voltages for grayscale levels under control of the control section so that for grayscale levels higher than or equal to a predetermined grayscale level, a different application voltage is assigned for each grayscale level to achieve a full grayscale display and that for the other grayscale levels, fewer grayscale levels are used for the display than those used for the full grayscale display.

2. The liquid crystal display device of claim 1, wherein:

the input image data indicator signal is a moving image/still image indicator signal;

the control section, in response to the moving image/still image indicator signal, controls the switching on/off by the switching section to enable the conversion process for the grayscale level signal in the data converting section during the display of a moving image and disable the conversion process for the grayscale level signal in the data converting section during a display of a still image.

3. The liquid crystal display device of claim 1, wherein the switching section enables the data conversion process carried out by the data converting section during a display of a moving image and disables the data conversion process carried out by the data converting section during a display of a still image.

4. The liquid crystal display device of claim 1, wherein the data converting section carries out the data conversion process so as to select, from application voltages that can be generated by the source driving section, those application voltages which are the closest to ideal application voltages in accordance with the grayscale levels in input image data.

5. A liquid crystal display device modulating application voltages according to grayscale levels in input image data to produce a grayscale display, said device comprising a source driving section for converting a grayscale level signal to application voltage outputs for output to a display section, the source driving section including:

a first converting section for converting the grayscale level signal to the application voltage outputs during a display of a still image;

a second converting section for converting the grayscale level signal to a grayscale level signal that is obtainable without using those application voltages which correspond to rising response speeds of the liquid crystal less than or equal to a predetermined value during a display of a moving image;

a selector section for selecting/switching between the first converting section and the second converting section for use; and a control section for controlling the switching by the selector section in accordance with an input image data indicator signal, wherein the source driving section, during display of a moving image, assigns application voltages for grayscale levels under control of the control section so that for grayscale levels higher than or equal to a predetermined grayscale level, a different application voltage is assigned for each grayscale level to achieve a full grayscale display and that for the other grayscale levels, fewer grayscale levels are used for the display than those used for the full grayscale display.

6. A liquid crystal display device modulating application voltages according to grayscale levels in input image data to produce a grayscale display, said device comprising:

a source driving section for converting a grayscale level signal for the input image data to application voltage outputs for output to a display section;

a data converting section, provided immediately before the source driving section, for converting the grayscale level signal to a grayscale level signal that is obtainable without using those application voltages which correspond to rising response speeds of the liquid crystal less than or equal to a predetermined value;

a switching section for selectively switching on/off a conversion process for the grayscale level signal in the data converting section; and a control section for controlling the switching on/off by the switching section in accordance with an input image data indicator signal, wherein the source driving section, during a display of a moving image, assigns application voltages for grayscale levels under control of the control section so that for grayscale levels lower than or equal to a predetermined grayscale level, a different application voltage is assigned for each grayscale level to achieve a full grayscale display and that for the other grayscale levels, fewer grayscale levels are used for the display than those used for the full grayscale display.

7. A liquid crystal display device modulating application voltages according to grayscale levels in input image data to produce a grayscale display, said device comprising a source driving section for converting a grayscale level signal to application voltage outputs for output to a display section, the source driving section including:

a first converting section for converting the grayscale level signal to the application voltage outputs during a display of a still image;

a second converting section for converting the grayscale level signal to a grayscale level signal that is obtainable without using those application voltages which correspond to rising response speeds of the liquid crystal less than or equal to a predetermined value during a display of a moving image;

a selector section for selecting/switching between the first converting section and the second converting section for use; and a control section for controlling the switching by the selector section in accordance with an input image data indicator signal, wherein the source driving section, during display of a moving image, assigns application voltages for grayscale levels under control of the control section so that for grayscale levels lower than or equal to a predetermined grayscale level, a different application voltage is assigned for each grayscale level to achieve a full grayscale display and that for the other grayscale levels, fewer grayscale levels are used for the display than those used for the full grayscale display.

* * * * *